US009623538B2

(12) United States Patent
Lynn

(10) Patent No.: US 9,623,538 B2
(45) Date of Patent: Apr. 18, 2017

(54) DEVICE AND METHOD FOR MULTIDIRECTIONAL BLASTING

(71) Applicant: William R. Lynn, Isle of Palms, SC (US)

(72) Inventor: William R. Lynn, Isle of Palms, SC (US)

( * ) Notice: Subject to any disclaimer, the term of this patent is extended or adjusted under 35 U.S.C. 154(b) by 0 days.

(21) Appl. No.: 14/607,317

(22) Filed: Jan. 28, 2015

(65) Prior Publication Data

US 2015/0224628 A1 Aug. 13, 2015

Related U.S. Application Data

(60) Provisional application No. 61/937,799, filed on Feb. 10, 2014.

(51) Int. Cl.
*B24C 5/04* (2006.01)

(52) U.S. Cl.
CPC ..... *B24C 5/04* (2013.01)

(58) Field of Classification Search
CPC ..... B24C 5/04
USPC ..... 451/102, 90, 75, 38, 39, 40, 2, 3
See application file for complete search history.

(56) References Cited

U.S. PATENT DOCUMENTS 1,953,311 A * 4/1934 Peik ..... B24C 5/02 118/DIG. 11
5,194,217 A * 3/1993 St. Louis ..... F22B 37/483 122/382
5,269,464 A * 12/1993 Epple ..... B60S 1/528 239/130
6,705,921 B1 * 3/2004 Shepherd ..... B24C 1/045 408/180
2011/0117823 A1 * 5/2011 Lynn ..... B24C 3/02 451/75

* cited by examiner

*Primary Examiner* — Robert Rose
(74) *Attorney, Agent, or Firm* — Davis & Bujold PLLC; Michael J. Bujold

(57) ABSTRACT

An adjustable surface treatment device which comprises a hollow elongate main body and an adjustable discharge nozzle being supported adjacent a free end of the main body. The adjustable discharge nozzle is coupled to a blasting media supply conduit for supplying blasting media thereto. An articulating mechanism is coupled to the adjustable discharge nozzle for adjusting a position of the adjustable discharge nozzle relative to the main body. method and system for positioning a tool in a desired orientation relative to a surface to be treated is also disclosed.

19 Claims, 4 Drawing Sheets

DEVICE AND METHOD FOR MULTIDIRECTIONAL BLASTING

FIELD OF THE INVENTION

This invention relates to a device and a method for facilitating desired access and treatment of areas of an object(s) or item(s) to be to treated with an articulated blasting wand or other surface treatment device or tool, in regions or areas which were previously very difficult or generally unreachable with a conventional blasting wand or tool, without either changing the position or orientation of the object(s) or item(s) to be treated or changing the position/location of the containment barrier, thereby improving the overall efficiency of the improved articulated blasting wand or other surface treatment device or tool.

BACKGROUND OF THE INVENTION

As is known in the art, treatment of a desired object, item, surface or area frequently occurs within an enclosed area, especially when treating a surface containing toxic and/or hazardous material and/or when collection and reuse of the surface treatment media is desired. Since the desired object, item, surface or area is located within a generally confined or sealed enclosure, it becomes periodically necessary for the operator to discontinue the surface treatment of the object(s), item(s) or surface(s), and either (1) rotate/reorientate the object(s), item(s) or surface(s) so that remaining areas of the object(s), item(s) or surface(s) can be treated or (2) alter/reposition the location of the containment barrier so that a new untreated section of the object(s), item(s) or surface(s) can be treated.

The inventor has found that during certain surface treatment applications within a confined enclosure or containment barrier, conventional blasting wands or other surface treatment devices or tools are typically unable to reach and discharge the blasting media to facilitate the desired surface treatment of the object(s), item(s) or surface(s) without frequently having to either reposition the confined enclosure or containment barrier and/or reorientate the object(s), item(s) or surface(s) to be treated. This is particularly true when the desired surface to treated faces away from the blasting wand or other surface treatment device or tool and/or is a surface facing away from the articulated blasting wand or other surface treatment tool. According, the blasting wand or other surface treatment tool must typically be relocated from a first location to another second location where "line of sight" access to the surface of the object(s), item(s) or surface(s) to be treated can be achieved. Such a relocation of the articulated blasting wand or other surface treatment device or tool is time consuming, inefficient and often also requires repositioning of a portion of the confined enclosure or the containment barrier. This generally leads to down time which increases the associated time and cost of the treatment process.

SUMMARY OF THE INVENTION

Wherefore, it is an object of the present invention to overcome the above mentioned shortcomings and drawbacks associated with the prior art by providing a device and method which assists with apply the desired blasting media to areas or sections of the object(s), item(s) or surface(s) to be treated without having to reorient the object(s), item(s) or surface(s) and/or reposition the confined enclosure or the containment barrier.

A further object of the invention is to facilitate articulation of the discharge end of the blasting wand or other surface treatment device or tool so that the discharge nozzle, of the improved articulated blasting wand or other surface treatment device or tool, can be reoriented, with respect to a main shaft of the improved articulated blasting wand or other surface treatment device or tool, into a variety of different discharge angles. That is, preferable the discharge nozzle, of the improved articulated blasting wand or other surface treatment device or tool, can be oriented with respect to a main shaft from a position in which the discharge nozzle is generally coincident and aligned with the main shaft to a position in which the discharge nozzle is arranged at an angle of 180 degrees with respect to the main shaft. Such movement or reorientation of the discharge nozzle, in combination with either extending or retracting of the improved articulated blasting wand or other surface treatment device or tool with respect to the confined enclosure or the containment barrier and/or rotation of the improved articulated blasting wand or other surface treatment device or tool thereby provides increased access to the object(s), item(s) or surface(s) to be treated and minimizes the amount of times that either (1) the enclosure must be repositioned, or (2) that the object(s), item(s) or surface(s) to be treated must be reorientated or repositioned.

BRIEF DESCRIPTION OF THE DRAWINGS

The invention will now be described, by way of example, with reference to the accompanying drawings in which.

DETAILED DESCRIPTION OF THE INVENTION

Figure 1:
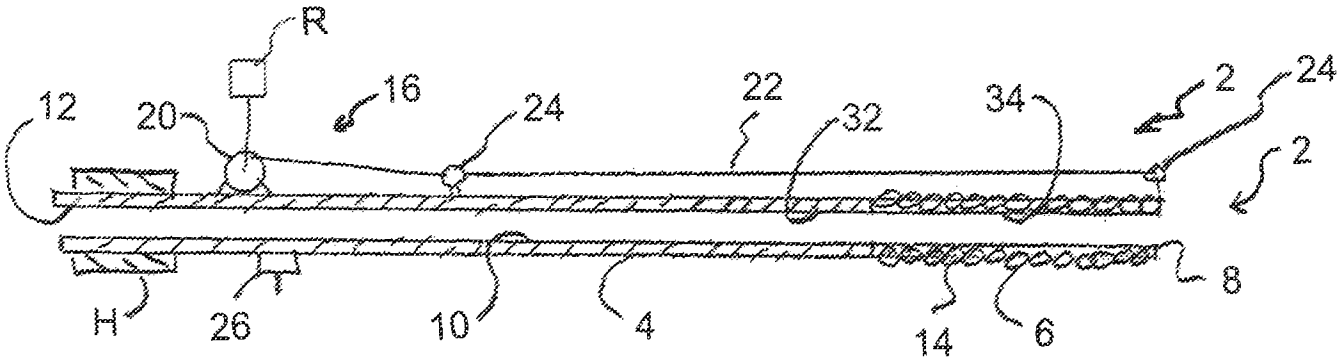
FIG. 1 is a simplified diagrammatic cross sectional view a first embodiment of the articulated blasting wand in a generally straight configuration so that the blasting media is discharged, from a discharge outlet of the blasting wand, substantially parallel to a longitudinal axis of the main shaft.

Turning now to FIG. 1, a detail description concerning the various components of the improved articulated blasting wand or other surface treatment device or tool, according to the present invention, will now be discussed.

As generally shown in FIG. 1, the improved articulated blasting wand or other surface treatment device or tool 2 generally comprises an elongate main shaft or body 4. The elongate main shaft or body 4 is generally hollow so as to from a flow path for supplying a desired blasting media to a discharge nozzle 8 of the improved articulated blasting wand or other surface treatment device or tool 2. A remote end section of the main body 4 comprises a flexible, bendable or rotatable section 6 which is attached to and formed integrally with the main body 4. That is, the flexible, bendable or rotatable section 6 is aligned and interconnected with the main body 4 so that the flexible, bendable or rotatable section 6 forms a continuation or extension of the main body 4. According to this embodiment, the remote end of the flexible, bendable or rotatable section 6 comprises the discharge nozzle 8. It is to be appreciated that the remote end of the flexible, bendable or rotatable section 6 can comprise or support a variety of other conventional components designed to provided the desired surface treatment to the object(s), item(s) or surface(s) to be treated. The main body 4 defines a longitudinal axis L of the improved articulated blasting wand or other surface treatment device or tool 2.

A flexible blasting media supply conduit 10 extends inside the improved articulated blasting wand or other surface treatment device or tool 2 from an inlet end 12 thereof to the discharge nozzle 8, through both the main body 4 and the flexible, bendable or rotatable section 6, to facilitate supplying blasting media to the discharge nozzle 8 where the blasting media is discharged. A leaf or coil spring 14 (e.g., a coil spring is diagrammatically shown in FIGS. 1-3), for example, is typically connected to the remote end of the main body 4 and generally surrounds all or a significant portion of the flexible, bendable or rotatable section 6. The coil spring 14 assists with returning and/or maintaining the flexible, bendable or rotatable section 6 in a generally substantially aligned orientation with respect to the longitudinal axis L of the main body 4, as generally shown in FIG. 1, so that the blasting media is discharged, from the discharge outlet or nozzle 8 of the blasting wand 2, substantially parallel to the longitudinal axis L of the main body 4. It is to be appreciated that one of the coil spring 14 and/or the flexible, bendable or rotatable section 6 may normally have a slight bend or curvature, along the length thereof, which promotes and/or assists with bending thereof as discussed below in further detail.

An articulating mechanism 16 is provided in order to assist with controlling and manipulating the amount that the remote end of the flexible, bendable or rotatable section 6 bends relative the longitudinal axis L of the main body 4, and thereby manipulate the discharge nozzle 8 into a desired orientation with respect to the main body 4. According to this embodiment, the articulating mechanism 16 generally comprises a convention wench or retch mechanism which is fixedly supported adjacent a handle end 18 of the main body 4 of the improved articulated blasting wand or other surface treatment device or tool 2. The wench or retch mechanism includes a rotatable spool 20 which is fixedly, but rotatably supported by the proximal end of the main body 4 and contains a desired length of a cable 22 and a conventional rotating mechanism, such as a crank or an electric motor (only diagrammatically shown as element R), which facilitates relatively slow rotation of the spool 20 in a desired rotation direction, e.g., to facilitate either retrieving or dispensing of the cable 22 by the spool as desired by the operator. A remote end of the cable 22 is permanently affixed to an eyelet 24 which is fixedly supported by the remote end of the improved articulated blasting wand or other surface treatment device or tool 2, closely adjacent the discharge nozzle 8. One or more additional eyelet guides 24 may be provided along the main body 4 and possibly also along the flexible, bendable or rotatable section 6 to assist with guiding the cable 22 both during retrieving and dispensing thereof by the spool 20.

If an electric motor is utilized, the electric motor may be controlled by a three position toggle switch in which a first position of the switch facilitates dispensing of the cable 22 from the spool 20, a second middle position prevents rotation of the spool 20 and maintains the current orientation of the discharge nozzle 8, and a third position facilitates retrieving of the cable 22 by the spool 20.

Figure 4:
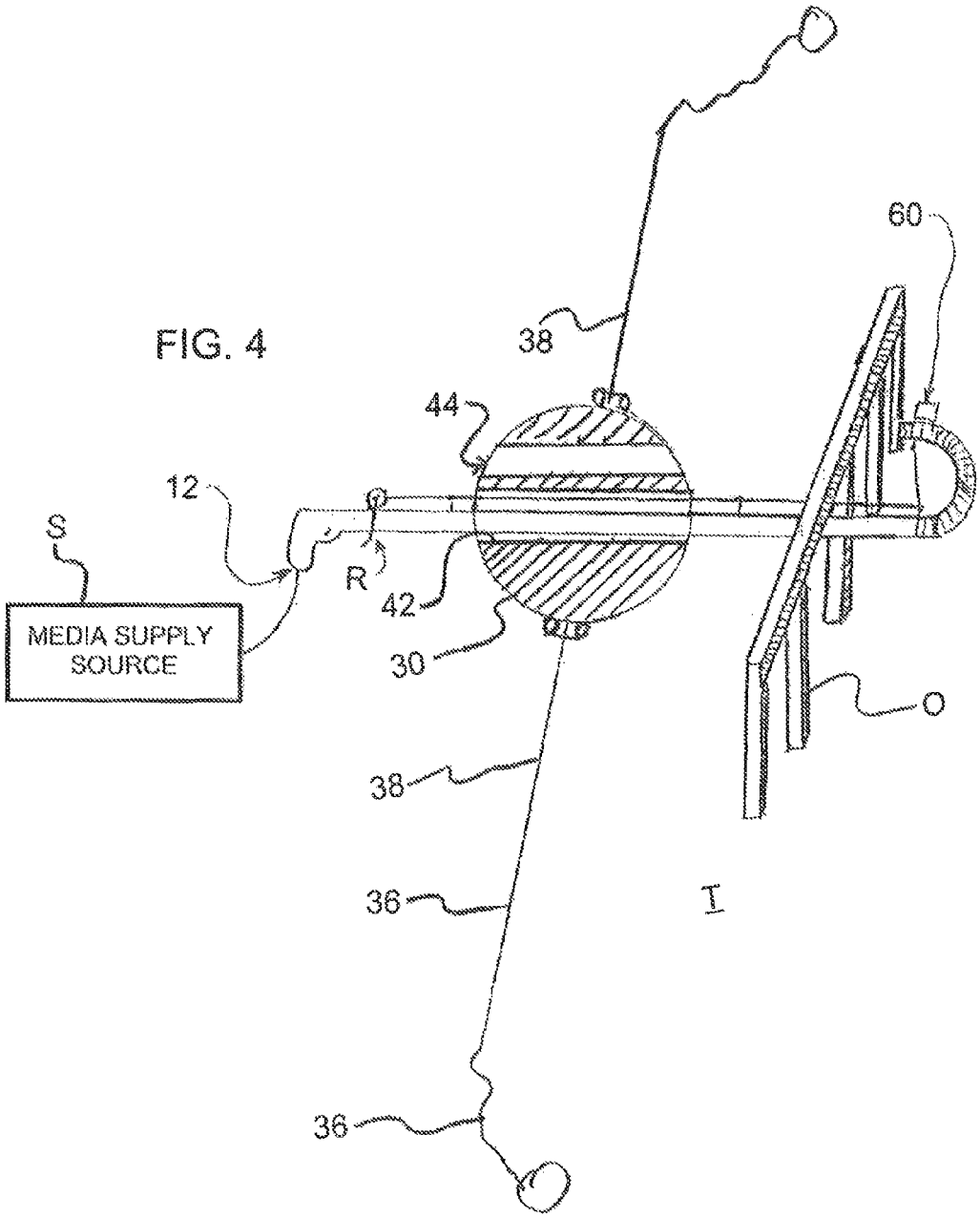
FIG. 4 is a simplified diagrammatic representation showing use of the articulated blasting wand, according to the first embodiment, in a fully bent configuration to provide access hard to reach areas.
Figure 6:
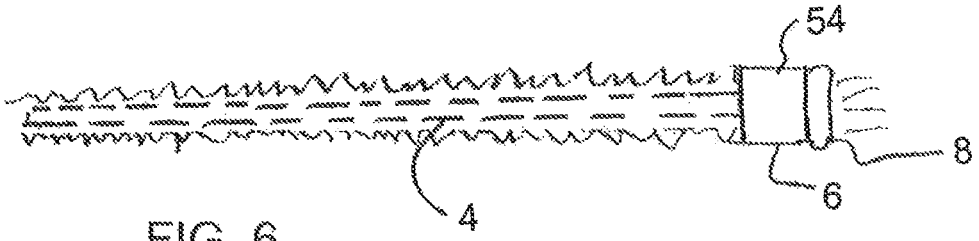
FIG. 6 is a diagrammatic top plan view of the articulated blasting wand of FIG. 5.
Figure 7:
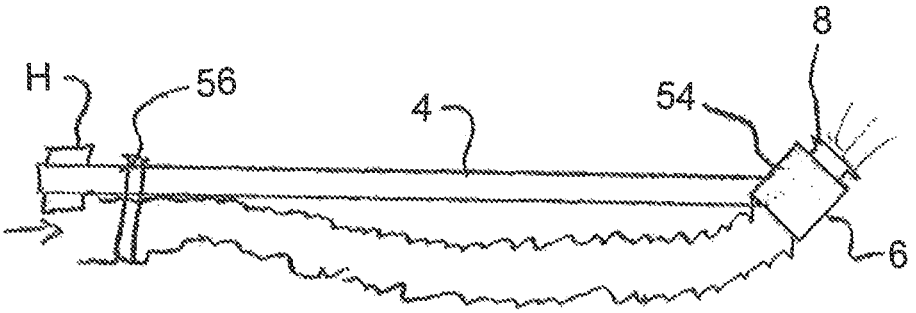
FIG. 7 is a diagrammatic top plan view showing the rotation of the cylindrical sleeve and the discharge outlet of the blasting wand of FIG. 5 in a partially pivoted configuration, relative to the main shaft, so that the blasting media is discharged, from the discharge outlet of the blasting wand, at an acute angle relative to the longitudinal axis of the main shaft.
Figure 8:
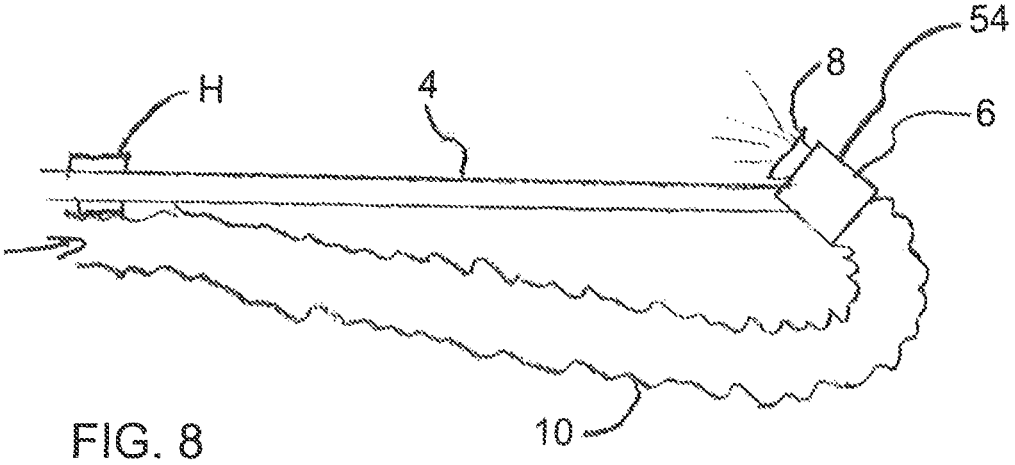
FIG. 8 is a diagrammatic top plan view showing the rotatable section of the articulated blasting wand of FIG. 5 in a generally fully rotated configuration, relative to the main shaft, so that the blasting media is discharged, from the discharge outlet of the blasting wand, at a 180 degree angle relative to the longitudinal axis of the main shaft.

The wench or retch mechanism is an inexpensive element that provides multiple stable articulated positions, and sufficient torque for articulating the free end of the flexible, bendable or rotatable section 6 relative to a remainder of the improved articulated blasting wand or other surface treatment device or tool 2. By positioning the wench or retch mechanism proximate to the handle H and a blasting media trigger 26, which controls the supply of the blasting media, the operator can readily and easily control the articulating mechanism 16 with one hand. In addition, the operator can readily and easily also simultaneously either extend/retract the blasting wand 2 and/or rotating or pivoting the blasting wand 2, relative a spherical orb 30 through which the operator can readily and easily projects as shown in FIG. 4, as needed, to suitably position the remote end of the blasting wand at a desired orientation with respect to a work surface so that the blasting media is discharge against the desired surface to be treated O.

The cable 22 is preferably manufactured from steel, nylon, Teflon®, etc., so as to provide sufficient strength, but also be able to withstand constant use within the blasting environment without damaging the cable.

As a result of such arrangement, when the spool 20 of the articulating mechanism is actuated so as to windup and retrieve some of the dispensed cable 22, the discharge nozzle 8 is gradually pulled toward the handle H of the improved articulated blasting wand or other surface treatment device or tool 2. Such pulling motion of the discharge nozzle 8 has a tendency to cause the flexible, bendable or rotatable section 6, of the improved articulated blasting wand or other surface treatment device or tool 2, to commence uniformly curving or bending with respect to the main body 4, generally without causing any bends, creases or kinks within the blasting media supply conduit 10, and, in turn, also causes the discharge nozzle 8 to be reorientated in a desired blasting configuration with respect to the main body 4.

Figure 2:
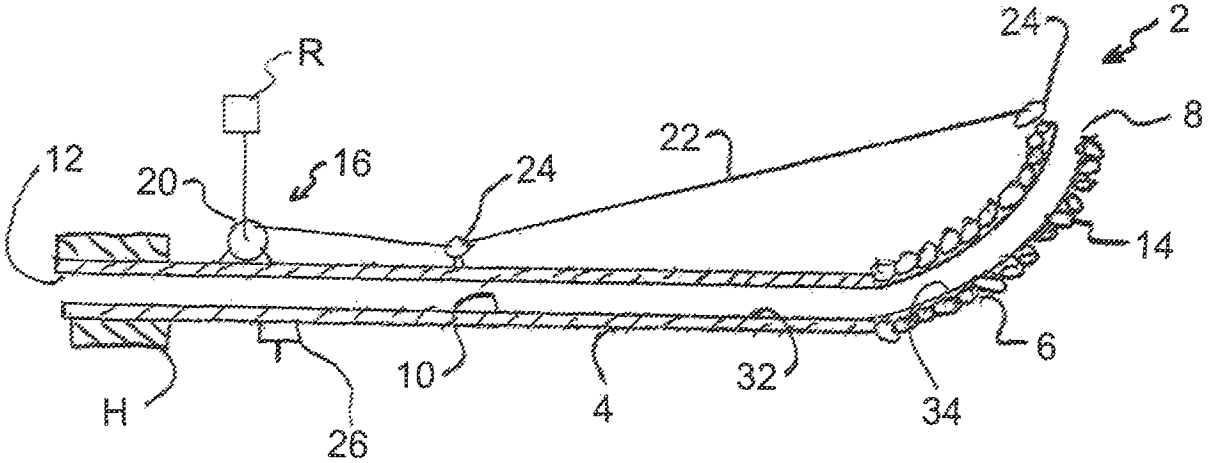
FIG. 2 is a simplified diagrammatic representation showing the rotatable section of the articulated blasting wand of FIG. 1 in a partially bent configuration relative to the main shaft so that the blasting media is discharged, from the discharge outlet of the blasting wand, at an acute angle relative to the longitudinal axis of the main shaft.
Figure 3:
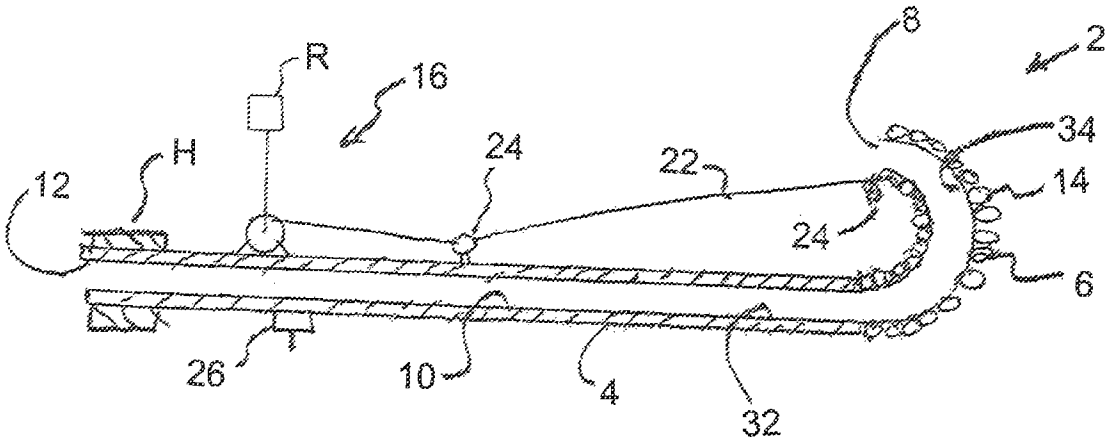
FIG. 3 is a simplified diagrammatic representation showing the rotatable section of the articulated blasting wand of FIG. 1 in a fully bent configuration relative to the main shaft so that the blasting media is discharged, from the discharge outlet of the blasting wand, at substantially a 180 degree angle relative to the longitudinal axis of the main shaft.

As the amount of cable 22 retrieved by the spool 20 gradually increases, this causes the flexible, bendable or rotatable section 6 to curve or bend further with respect to the main body 4 and thereby further gradually increase the discharge angle of the blasting media from the discharge nozzle 8 with respect to the longitudinal axis L defined by the main body 4 (see FIG. 2). Once a maximum amount of cable 22 is retrieved by the spool 20, the flexible, bendable or rotatable section 6 is generally in the shape of a hemisphere configuration so that the blasting media is discharged from the discharge nozzle 8 an angle of about 180 with respect to the longitudinal axis L of the main body 4 (see FIG. 3). Conversely, as cable 22 is gradually dispensed from the spool 20, this gradually reduces the pulling force exerted on the flexible, bendable or rotatable section 6 so that the leaf or coil spring 14 is able to gradually bias and return the flexible, bendable or rotatable section 6 back into is substantially normally aligned orientation with the main body 4, as generally shown in FIG. 1.

According to the first embodiment, the blasting media conduit 10 generally comprises two sections which are generally concentric and aligned with one another, namely, a first section 32 located within the main body 4 and a second section 34 located within the flexible, bendable or rotatable section 6. Since the second section 34, located within the flexible, bendable or rotatable section 6, tends to bend frequently along with bending of the flexible, bendable or rotatable section 6, as the blasting media flows along the bent configuration of the second section 43 (see FIGS. 2 and 3), the blasting media tends to abut or impact against at least one side of the second section 34 of the flexible, bendable or rotatable section 6 which tends to wear and/or abrade a portion of the second section 34 thereby possibly causing the second section 34 of the blasting media conduit 10 to be replaced more frequently than the first section 32 of the blasting media conduit 10.

The first section 32 of the blasting media conduit 10 is preferably formed from a metal tube, such as steel, or possibly a hard plastic, depending upon the type of blasting media to be conveyed and supplied to the discharge nozzle 8, while the second section 34 may be flexible, and formed of a flexible tube such as rubber, corrugated plastic, or other synthetic material which will not significantly obstruct the flow of the blasting media therethrough during use. The second section 34 may be may also be formed from braided steel, an interlock wound single strip metal hose, gooseneck tubing, or the like which will readily conform with the bending of the flexible, bendable or rotatable section 6 induced by the articulating mechanism 16.

As diagrammatically shown in FIG. 4, the improved articulated blasting wand or other surface treatment device or tool 2, of FIG. 1, is shown mounted within a spherical orb 30 which provides access to an interior of an enclosed blasting enclosure, e.g., a conventional rigid/flexible barrier 36 facilitates complete separation of an enclosed treatment area T from a remaining exterior environment. As generally shown, a rigid support panel 38 forms a rigid barrier which separates the enclosed treatment area T from the exterior environment and facilitates pivoting of the spherical orb 30. The rigid support panel 38 has a centrally located access aperture formed therein which rotatably and pivotably supports the spherical orb 30. The spherical orb 30 has a wand port 42 for accommodating the improved articulated blasting wand or other adjustable surface treatment device or device or tool 2 and typically also has a viewing aperture 44 which facilitates viewing of a surface of the object(s), item(s) or surface(s) to be treated during the surface treatment. As is conventional in the art, the spherical orb 30 is able to pivot both up and down approximate 150-180° and left and right approximate 150-180° in each one of those directions.

The wand port 42 of the spherical orb 30 is sized to so as to permit an operator to extend the improved articulated blasting wand or other surface treatment device or device or tool 2 further through the wand port 42 as well as retract the improved articulated blasting wand or other surface treatment device or device or tool 2 relative to the wand port 42 while also permitting the operator to rotate the improved articulated blasting wand or other surface treatment device or device or tool 2, in either rotational direction, with respect to the wand port 42 of the spherical orb 30, so as to manually position the improved articulated blasting wand or other adjustable surface treatment device or tool 2 and perform the desired surface treatment of the object(s), item(s) or surface(s) to be treated. As is conventional in the art, the end of the wand port 42, which faces and communicates with the enclosed treatment area T, has a flexible seal which generally seals against the exterior surface of the improved articulated blasting wand or other adjustable surface treatment device or tool 2, so as to minimize any blasting media from entering into the wand port 40 during blasting, while still allowing the adjustable surface treatment device or tool 2 to be moved relative to the wand port 42.

The object(s), item(s) or surface(s) to be treated O, e.g., a fence in this instance, is diagrammatically shown on the right side of FIG. 4. The inlet end 12 of the improved articulated blasting wand or other surface treatment device or device or tool 2 blasting wand is coupled, in a conventional manner, to a desired media supply source S for supplying the desired blasting media, at a desired flow rate and supply pressure, to the inlet end 12 of the improved articulated blasting wand or other surface treatment device or device or tool 2. The blasting media is typically conveyed by a transfer fluid such as air, but the conveying fluid may possibly be water, a solvent or some other liquid, depending on the particular application.

The improved articulated blasting wand or other surface treatment device or device or tool 2 is then directed, aimed and positioned, by the operator via manipulation of the improved articulated blasting wand or other surface treatment tool 2 and/or pivoting movement of the spherical orb 30 at the desired area or surface of the object(s), item(s) or surface(s) to be treated O and the trigger 26 is actuated to commence surface treatment in a conventional manner. The conveyed blasting media then is supply from the media supply source S to the improved articulated blasting wand or other surface treatment device or tool 2 where the blasting media flows along the blasting media conduit 10 and is eventually is discharged out of the blasting nozzle 8, at the desired flow rate and pressure, against surface or area of the object(s), item(s) or surface(s) to be treated O.

Typically, once all of the directly available surfaces of the object(s), item(s) or surface(s) to be treated O are adequately treated by either (1) pivoting/rotating the spherical orb 30, (2) inserting and/or retracting the improved articulated blasting wand or other surface treatment device or tool 2 with respect to the spherical orb 30, or (3) rotating the improved articulated blasting wand or other surface treatment device or tool 2, about its longitudinal axis L, with respect to the spherical orb 30, the operator typically will then activate the articulating mechanism 16 to assist with manipulating or positioning the flexible, bendable or rotatable section 6, and thus the discharge nozzle 8, into a desired orientation with respect to the main body 4 and commence further surface treatment of the object(s), item(s) or surface(s) to be treated O to treat areas/surfaces which were not in the line of sight of the operator without having to reposition either the spherical orb 30 and/or the object(s), item(s) or surface(s) to be treated O.

This process of (1) pivoting/rotating the spherical orb 30, (2) inserting and/or retracting the improved articulated blasting wand or other surface treatment device or tool 2 with respect to the spherical orb 30, or (3) rotating the improved articulated blasting wand or other surface treatment device or tool 2, about its longitudinal axis L, with respect to the spherical orb 30, (4) activating the articulating mechanism 16 is repeatedly repeated, as necessary, until repositioning of either the spherical orb 30 and/or the object(s), item(s) or surface(s) to be treated O is generally deemed advisable by the operator.

Turning now to FIGS. 5-8, a detail description concerning a second embodiment of the improved articulated blasting wand or other surface treatment tool 2, according to the present invention, will now be described in detail. As this embodiment is somewhat similar to the previously described embodiment, only the differences between this embodiment and the previously described embodiment will now be described in detail.

Figure 5A:
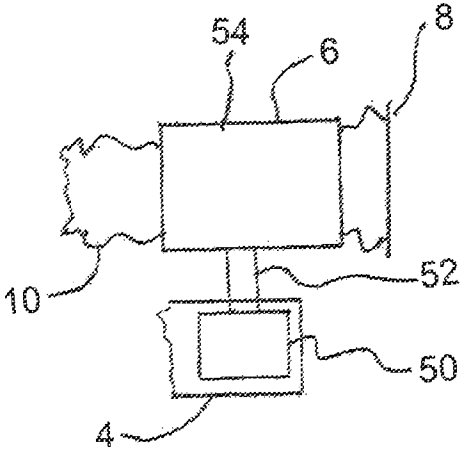
FIG. 5A is an exploded diagrammatic representation showing a rotatable motor which couples a remote end of the main body to the cylindrical sleeve which supports and controls the orientation of the discharge outlet of the blasting wand.
Figure 5:
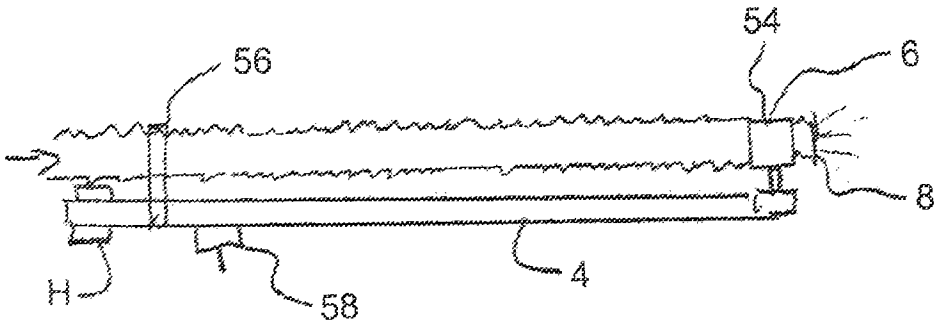
FIG. 5 is a simplified diagrammatic representation showing a side elevational view of a second embodiment of the articulated blasting wand according to the present invention in which the blasting media is discharged, from a discharge outlet of the blasting wand, substantially parallel to a longitudinal axis of the main shaft.

According to this embodiment, the improved articulated blasting wand or other surface treatment device or tool 2 comprises a main body 4 which supports a rotatable section 6 at a remote end of the main body 4. The articulating mechanism 16 (see FIGS. 5 and 5A), according to this embodiment, generally comprises an electric motor 50, e.g., a stepper motor, which couples the rotatable section 6 to the remote end of the main body 4. That is, the base of the motor 50 is typically supported and/or accommodated by the remote end of the main body 4 and a rotatable shaft 52, which is driven by the motor 50, supports the rotatable section 6. It is to be appreciated that the opposite arrangement is also possible, e.g., the base of the motor 50 may be supported or accommodated by the rotatable section 6 while the rotatable shaft 52 of the motor may be connected to the remote end of the main body 4. As the shaft 52 is rotated by the motor 50, the rotatable section 6 correspondingly rotates with respect to the remote end of the main body 4. Preferably the shaft 52 rotates at a relatively slow rotation speed with respect to the motor 52, or the motor gearing is correspondingly reduced, so that the shaft 52 rotates about one half a rotation in about 3-30 second or so.

The rotatable section 6, according to this embodiment, comprises a cylindrical sleeve 54 which is sized to captively receive, accommodate and retain a distal end of the blasting media supply conduit 10. As shown, the blasting media supply conduit 10 generally extends parallel to and along the exterior of the main body 4 and the distal end thereof eventually passes completely through the cylindrical sleeve 54 of the rotatable section 6. One or more retaining clamps 56 can be provided for loosely coupling and supporting a portion of the blasting media supply conduit 10 to the main body 4. It is to be appreciated that a sufficient amount of slack or excess blasting media supply conduit 10 must be located between a trailing end of the cylindrical sleeve 54 of the rotatable section 6 and the retaining clamp 56 to permit the desired rotation or pivoting of the cylindrical sleeve 54 of the rotatable section 6, with respect to the main body 4, without unduly stretch and/or forming any undesired bends or kinks in the blasting media supply conduit 10 which could hinder or obstruct the flow of blasting media through the blasting media supply conduit 10 during surface treatment.

The discharge nozzle 8 is preferably affixed to or located closely adjacent a leading end of the cylindrical sleeve 54 of the rotatable section 6. A conventional three position toggle switch 58 is located adjacent the handle end of the improved articulated blasting wand or other surface treatment device or tool 2 to facilitate control of the rotatable section 6 by an operator. An electrical connection (not shown) extends between the switch 58 and the motor 50, and this connection is preferably accommodated within the main body 4 so as to protect the electrical connection from damage during blasting. The switch 58 is coupled, in a conventional manner, to a conventional power source (not shown) or possibly a battery, such as a lithium battery for supplying power to the motor 50 to control operation thereof.

As a result of such arrangement, when the operator activates the conventional three position toggle switch 58 in a first position, motor 50 rotates the rotatable section 6 in a first rotational direction with respect to the remote end of the main body 4, when the operator activates the switch 58 in a second middle position rotation of the motor 50 discontinues and motor 50/discharge nozzle 8 are maintained in their current orientation, and when the operator activates the conventional switch 58 in a third position, the motor 50 rotates the rotatable section 6 in an opposite second rotational direction with respect to the remote end of the main body 4. It will be appreciated that by suitable manipulation of the discharge nozzle 8, via manipulation of the switch 58/motor 50/cylindrical sleeve 54, the discharge nozzle 8 can be suitable reorientated and/or repositioned with respect to the remote end of the main body 4 to assist with providing blasting media access to regions or areas of the object(s), item(s) or surface(s) to be treated O which were not previously accessible by prior art wands or other surface treatment devices or tools.

While the blasting media supply conduit 10 is shown as generally extends parallel to the main body 4, it is to be appreciated that the blasting media supply conduit 10 may possibly extend through the barrier 36, 38 instead of passing through the wand port 42 of the spherical orb 30, without departing form the spirit and scope of the present invention.

It is to be appreciated that a camera and/or light may be supported adjacent the discharge nozzle 8 to provide remote viewing by the operator of areas or regions which are not visible via a typical line of sight viewing from the viewing port 44 of the spherical orb 30. The camera and/or light provide improved visibility for such areas or regions to be treated. The camera can be coupled to a monitor (not shown), in a conventional manner, to provide viewing of surface treatment which is out of the line of sight of the operator. The camera and the light are preferably of a robust design which is able withstand the harsh conditions and environment which typically occurs within the enclosed treatment area T. The camera and/or the light may preferably be enclosed within a sealed transparent housing, generally indicated as element 60 (see FIG. 4), which is scratch resistant.

Since certain changes may be made in the above described the improved articulated blasting wand or other surface treatment device or tool, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. An adjustable surface treatment device comprising:

a rigid elongate main body;

a flexible blasting media supply conduit having an adjustable discharge nozzle supported adjacent a free end of the flexible blasting media supply conduit;

at least a section of the flexible blasting media supply conduit being supported by the main body;

an articulating mechanism coupling the main body to the adjustable discharge nozzle for facilitating adjustment of an angular position of the adjustable discharge nozzle relative to the main body; and the articulating mechanism being supported by an exterior surface of the main body;

wherein the flexible blasting media supply conduit extends inside the main body of the surface treatment device from an inlet end thereof toward the discharge nozzle, a spring is connected to a remote end of the main body, the spring encompasses a flexible section of the flexible blasting media supply conduit, which extends beyond the main body, and the flexible blasting media supply conduit facilitates supplying blasting media to the discharge nozzle.

2. The adjustable surface treatment device according to claim 1, wherein the blasting media supply conduit is fixedly connected to and is formed integrally with the main body so that the blasting media supply conduit forms an extension of the main body.

3. The adjustable surface treatment device according to claim 1, wherein the spring completely surrounds at least a portion of the flexible section of the flexible blasting media supply conduit, and the spring assists with maintaining the flexible section in a substantially aligned orientation with respect to a longitudinal axis of the main body.

4. The adjustable surface treatment device according to claim 1, wherein one of the spring or the flexible section of the flexible blasting media supply conduit has a slightly bent or curved orientation, with respect to a longitudinal axis of the main body, which promotes bending the flexible section.

5. The adjustable surface treatment device according to claim 2, wherein the articulating mechanism is coupled, via at least one retaining device, adjacent a free end of the flexible section; and at least a second retaining device couples the articulating mechanism to the main body to facilitate manipulation of an orientation of the discharge nozzle relative to a longitudinal axis of the main body, and thereby manipulate the discharge nozzle into a desired discharge orientation with respect to the main body.

6. The adjustable surface treatment device according to claim 5, wherein the articulating mechanism comprises a ratch mechanism fixedly supported adjacent a handle end of the main body of the surface treatment device, the ratch mechanism includes a rotatable spool which contains a cable, and a rotating mechanism facilitates rotation of the spool, in a desired rotation direction, to facilitate retrieving or dispensing of the cable by the spool as desired by an operator; and a remote end of the cable is permanently affixed to the at least one retaining device, which is an eyelet fixedly supported adjacent the discharge nozzle.

7. The adjustable surface treatment device according to claim 6, wherein at least one eyelet guide is provided externally along the main body to assist with retrieving or dispensing of the cable by the spool.

8. The adjustable surface treatment device according to claim 1, wherein at least one retaining device couples the adjustable discharge nozzle to the main body, and the articulating mechanism comprises a motor which couples the flexible section to the free end of the main body so that the flexible section is adjustable with respect to the free end of the main body.

9. The adjustable surface treatment device according to claim 1, wherein the flexible section is coupled to the main body by the at least one retaining device which comprises a cylindrical sleeve which is sized to captively receive, accommodate and retain a distal end of the blasting media supply conduit.

10. An adjustable surface treatment device comprising:

a hollow elongate main body;

an adjustable discharge nozzle being supported adjacent a free end of the main body;

the adjustable discharge nozzle being coupled to a blasting media supply conduit for supplying blasting media thereto;

an articulating mechanism coupled to the adjustable discharge nozzle for adjusting a discharge position of the adjustable discharge nozzle relative to the main body; and the blasting media supply conduit extending along an exterior of the main body and a distal end of the blasting media supply conduit passes through a cylindrical sleeve of a flexible section of the blasting media supply conduit, and at least one retaining clamp being provided for coupling and supporting a portion of the blasting media supply conduit on the main body.

11. An adjustable surface treatment device comprising:

a rigid elongate main body;

a flexible blasting media supply conduit having an adjustable discharge nozzle supported adjacent a free end of the flexible blasting media supply conduit;

a section of the flexible blasting media supply conduit being permanently connected to the main body;

an articulating mechanism coupling the main body to the adjustable discharge nozzle for facilitating adjustment of an angular position of the adjustable discharge nozzle relative to the main body; and the articulating mechanism being supported by an exterior surface of the main body;

wherein the adjustable surface treatment device is used in combination with a spherical orb and a barrier;

the barrier supports the spherical orb and facilitates separation of an enclosed treatment area from an exterior environment; and the spherical orb provides access for the adjustable surface treatment device into an interior of the enclosed treatment area.

12. The adjustable surface treatment device according to claim 11, wherein the barrier comprises a rigid support panel with an aperture formed therein, and the aperture of the barrier is sized to accommodate the spherical orb such that the barrier supports the spherical orb within the aperture and facilitates pivoting thereof.

13. The adjustable surface treatment device according to claim 11, wherein the spherical orb comprises a wand port for accommodating the adjustable surface treatment device and a viewing aperture which facilitates viewing of a surface to be treated, and the spherical orb is able to pivot both up and down and left and right approximately 180° in each direction.

14. The adjustable surface treatment device according to claim 13, wherein the wand port of the spherical orb is sized so as to permit an operator to extend and retract the adjustable surface treatment device, relative to the wand port, and also permit an operator to manipulate the adjustable surface treatment device relative to the wand port.

15. The adjustable surface treatment device according to claim 11, wherein at least one of a camera and a light is supported adjacent the discharge nozzle to provide remote viewing of an area or a region which is not visible via a line of sight viewing from the viewing port of the spherical orb.

16. The adjustable surface treatment device according to claim 1, wherein an inlet end of the adjustable surface treatment device is coupled to a media supply source to facilitate supplying the desired blasting media, at a desired flow rate and supply pressure, to the adjustable discharge nozzle.

17. The adjustable surface treatment device according to claim 1, further comprising an orb which supports the main body and provides access to an interior of an enclosed treatment area defined by a barrier; and the rigid body is adjustable lengthwise through the spherical orb; and rotatable with the spherical orb, such that the adjustable surface treatment device is adjustable by:

pivoting of the orb with respect to the enclosed treatment area;

extending and retracting of the main body with respect to the orb; and angular adjustment of the adjustable discharge nozzle relative to a longitudinal axis of the main body.

18. The adjustable surface treatment device according to claim 11, wherein an inlet end of the adjustable surface treatment device is coupled to a media supply source to facilitate supplying the desired blasting media, at a desired flow rate and supply pressure, to the adjustable discharge nozzle.

19. The adjustable surface treatment device according to claim 1, wherein the adjustable surface treatment device is used in combination with a spherical orb and a barrier;

the barrier supports the spherical orb and facilitates partitioning of an enclosed treatment area from an exterior environment; and the spherical orb provides access for the adjustable surface treatment device into an interior of the enclosed treatment area.

* * * * *